United States Patent [19]

Baltschun

[11] Patent Number: 4,890,475

[45] Date of Patent: Jan. 2, 1990

[54] PRESTRESSED HYDRAULIC PRESS

[75] Inventor: Horst Baltschun, Rulzheim, Fed. Rep. of Germany

[73] Assignee: Maschinenfabrik Lauffer GmbH & Co. KG, Horb, Fed. Rep. of Germany

[21] Appl. No.: 236,462

[22] Filed: Aug. 25, 1988

[30] Foreign Application Priority Data

Aug. 26, 1987 [DE] Fed. Rep. of Germany ..... 3728418

[51] Int. Cl.[4] ..... B21D 37/12

[52] U.S. Cl. ..... 72/455; 72/453.02; 100/214; 100/258 R

[58] Field of Search ..... 72/453.02, 453.06, 453.08, 72/453.07, 456, 455, 453.14; 100/214, 258 R

[56] References Cited

U.S. PATENT DOCUMENTS 4,291,571 9/1981 Claussen ..... 72/455
4,809,535 3/1989 Ellis ..... 72/453.06

FOREIGN PATENT DOCUMENTS 959309 12/1974 Canada ..... 72/453.02
548352 2/1977 U.S.S.R. ..... 72/453.14

*Primary Examiner*—David Jones
*Attorney, Agent, or Firm*—Bachman & LaPointe

[57] ABSTRACT

A prestressed hydraulic press includes a pressure generator for selectively prestressing the hydraulic press such that the press is under substantially constant stress during all phase operations of the hydraulic press.

10 Claims, 7 Drawing Sheets

PRESTRESSED HYDRAULIC PRESS

Figure 1:
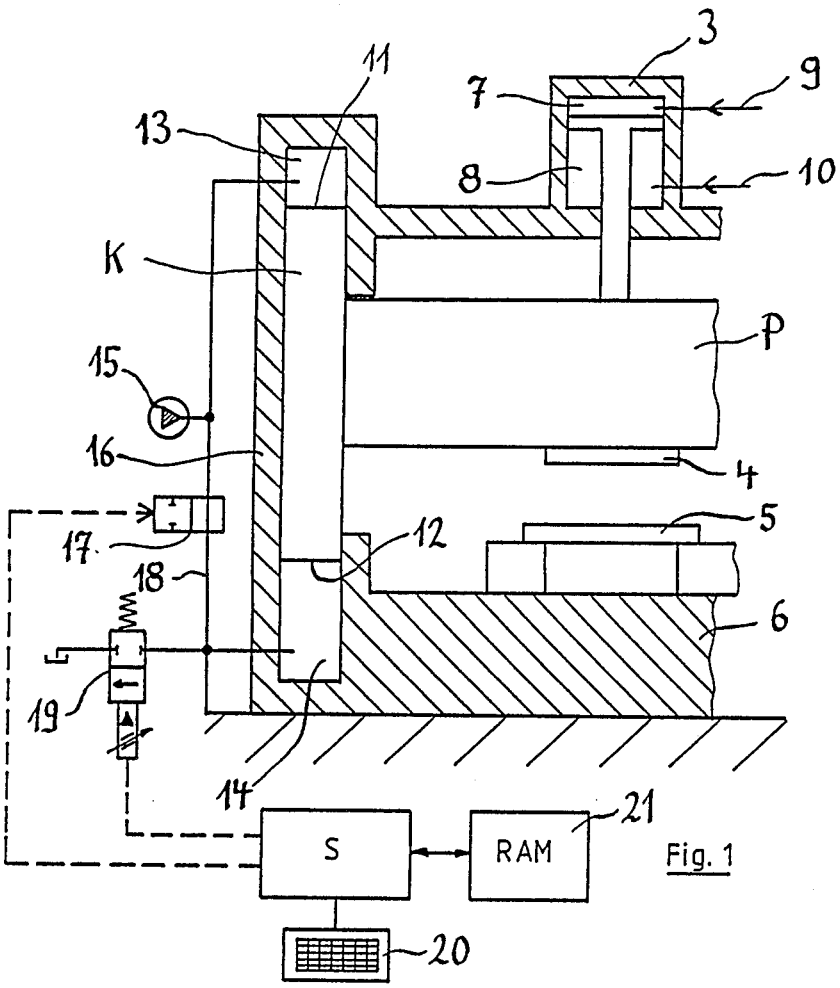

The invention relates to a hydraulic press according to the main claim.

Hydraulic presses are e.g. used for metal working pruposes and using a high pressure, which can be several kilonewtons, metal is stamped, shaped or otherwise worked. The known presses have a press frame, in which are arranged the press top or crown with the ram and the press base. When working with the known presses a strain or tension is built up in the press frame which corresponds to the press pressure and this suddenly drops at the end of the working operation. Brief expansions occur during the working stroke in the press frame or support and require an expansion work which is percussively wasted in completely unused manner at the end of the particular working stroke. In addition, the expansion which occurs can impair the accuracy of the pressing process.

DE-OS 28 24 176 discloses a hydraulic press, which uses damping cylinders enabling at the end of the working stroke the damping of the otherwise percussive unstressing of the press. In such an edge press, it is not possible to avoid that the press is stressed again during each press cycle, so that the aforementioned disadvantages can be avoided.

DE-OS 27 39 340 discloses a hydraulically operated press, which has a press ram, which is connected to piston rods, which engage with pistons in the cylinder chambers, which are on the one hand mounted on the lower press frame and on the other hand on a press crosshead. If in this known arrangement pressure is built upon the cylinder chambers, then the press can be prestressed, but the press frame in which said crosshead is mounted must absorb these tensile forces. The tensile forces occurring in the frame cannot be introduced axially and symmetrically to the piston rods into the press frame, so that the prestressing forces lead to bending stresses in the frame and consequently an exact pressing process is prejudiced.

The problem of the invention is to provide a prestressable hydraulic press, whose stress is not lost at the end of a working stroke and which requires no crosshead fixed in an all-round press frame.

According to the invention this problem is solved in the case of a press of the aforementioned type by the characterizing features of the main claim. The press ram is connected to the piston rods, which project at either end into cylinder chambers, which are preferably located in the vicinity of the press columns. Prior to the operating stroke the cylinder chambers are pressurized in such a way that at both ends of the piston rods equal, but oppositely directed forces act. The reaction forces lead to a stressing of the press and therefore the columns. The press crown with the ram can be vertically moved with limited force expenditure and engaged with the workpiece in a working position. The working stroke is e.g. initiated in that the lower cylinder chambers are balanced, so that there is no longer an equilibrium of forces on the piston rods. Thus, in accordance with the balance, the press ram moves against the workpiece, so that once again an opposing force is built up there and consequently the bracing of the press is maintained. The columns or corresponding tie rods, which connect the upper part to the lower part of the press, continue to be prestressed. At the end of the working stroke by means of controllable valves the pressure previously reduced in the lower cylinder chambers is increased again, so that the prestressing of the columns is maintained. The effective piston faces of the piston rods can obviously be of varying size, but then correspondingly different pressures must be built up in the cylinder chambers, in order to be able to transfer equally large pressure forces to the piston rods for achieving an equilibrium of forces. Preferably the piston faces are of the same size, so that identical pressure forces can be obtained in that the cylinder chambers are coupled via pressure lines and are connected to a common pressure generator. In order to initiate the working stroke, it is then merely necessary to interrupt the connecting line between the upper and lower cylinder chambers and to lower the pressure in clearly defined manner in the lower cylinder chamber, so that there is a downwards movement of the press ram and consequently a deformation or some other working of the workpiece.

In the preferred embodiment the piston rods are constructed in the tubular manner and surround tie rods or columns running between the upper and lower press parts. The piston faces are annular surfaces, which project into cylinder chambers and as annular rings surround the tie rods or columns in the vicinity of their two ends. As a result of such a piston rod construction, it is achieved that the expansion forces produced by the constant prestressing precisely act in the axial direction on the tie rods or columns.

The upper cylinder chambers can in each case be interconnected with the lower cylinder chambers by means of a longitudinal bore located in each column and which can be shut off by means of a controllable valve. Therefore no additional external pressure lines are required for connecting the pressure chambers and a very flow-favourable cylinder chamber connection can be obtained, which allows a movement of the press ram before and after the working stroke with limited force expenditure by means of an operating cylinder.

The one-sided pressure relief of the cylinder chambers is preferably achieved by means of controllable valves, which are operated by an electronic control system. The latter can effect the pressure relief as a function of sensor signals, which e.g. recognize an eccentric loading of the press ram by the eccentric arrangement of the workpiece. The sensors can be in the form of pressure sensors, which are associated with the cylinder chambers. However, it is also possible to use angle sensors or displacement transducers, which can establish an inclined or sloping position of the ram, so that by means of the control system it is possible to individually operate control valves individually associated with the lower cylinder chambers. Thus, in the case of a press with four piston rods, it is possible to bring about in the vicinity of its four columns a different pressure relief on each column, in order to avoid an inclination of the press ram in the case of eccentric loading.

In the vicinity of the upper ends of the columns, the press can have mechanical adjusting means, which allow a vertical adjustments of the press ram with respect to the piston rods.

It is also possible to arrange several hydraulic presses in a mechanical lifting means in such a way that the press tops are movable by a common rapid approach means into the position in which the working stroke begins. Thus, it is possible to obviate several operating cylinders, because they are replaced by a common rapid approach means.

The invention is described in greater detail hereinafter relative to the drawings, wherein show:

FIG. 1 a detail of a simplified embodiment of a press for illustrating the operating principle.

Figure 2:
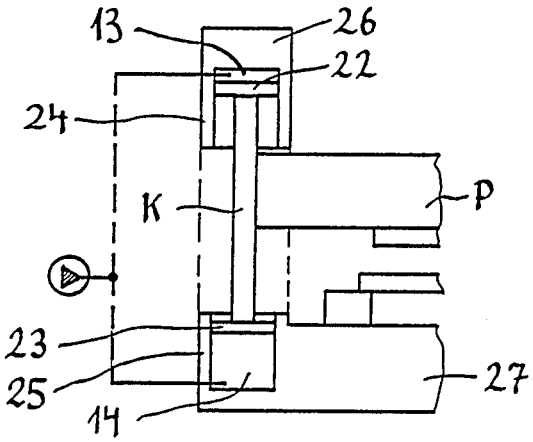

FIG. 2 a further simplifed embodiment.

Figure 3:
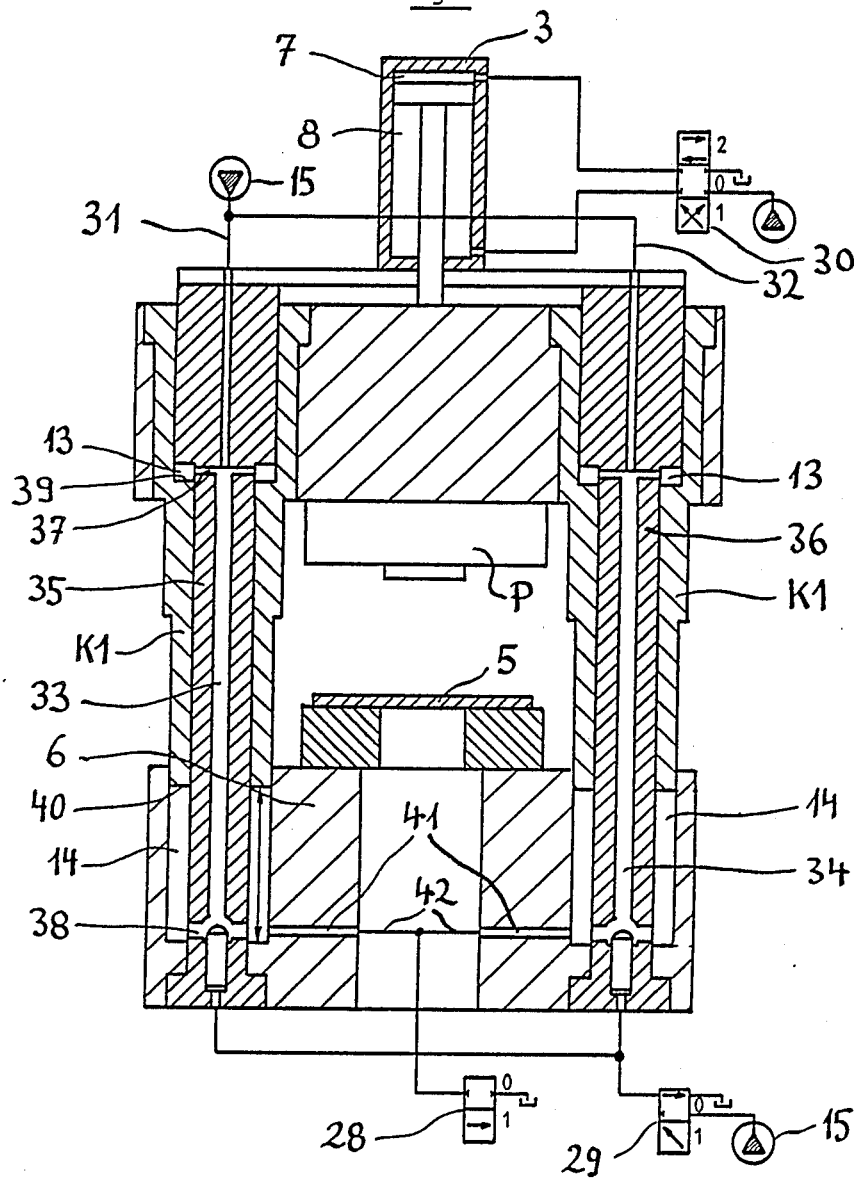

FIG. 3 a preferred construction of the inventive press in the prestressed state.

Figure 4:
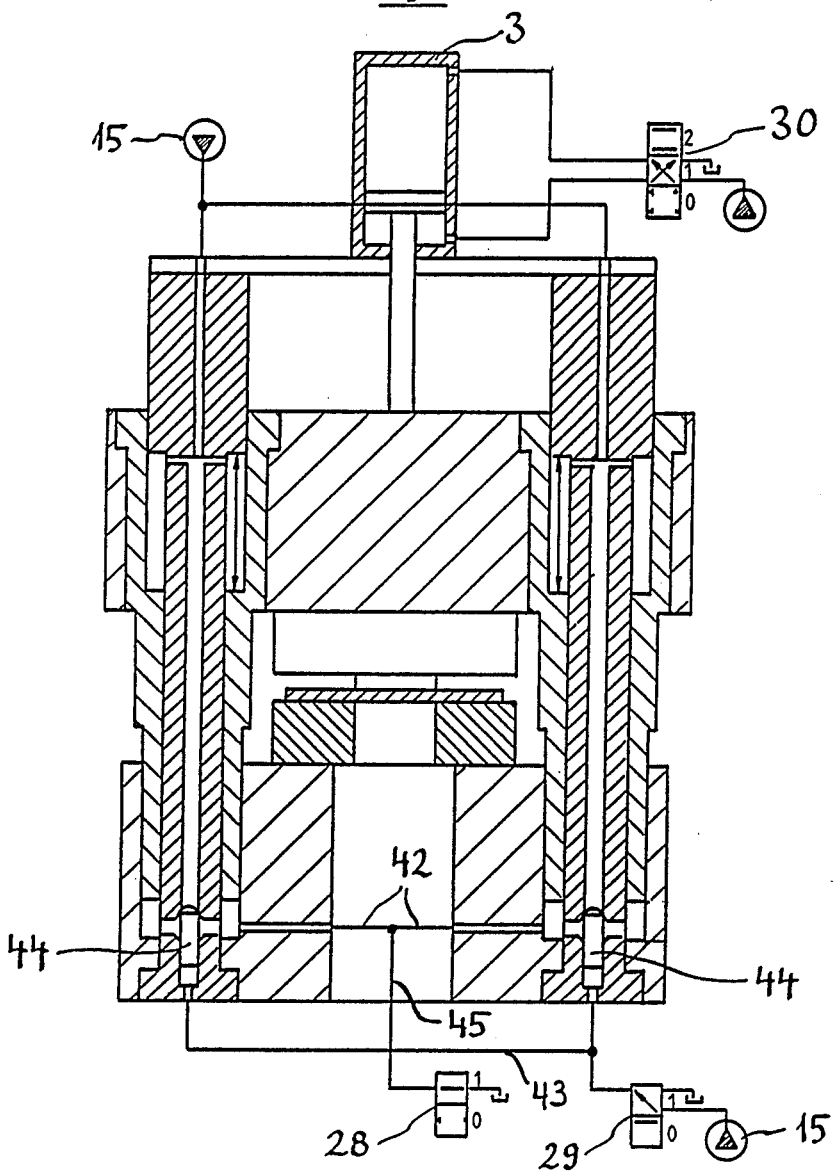

FIG. 4 the press according to FIG. 3 directly prior to the start of the working stroke.

Figure 5:
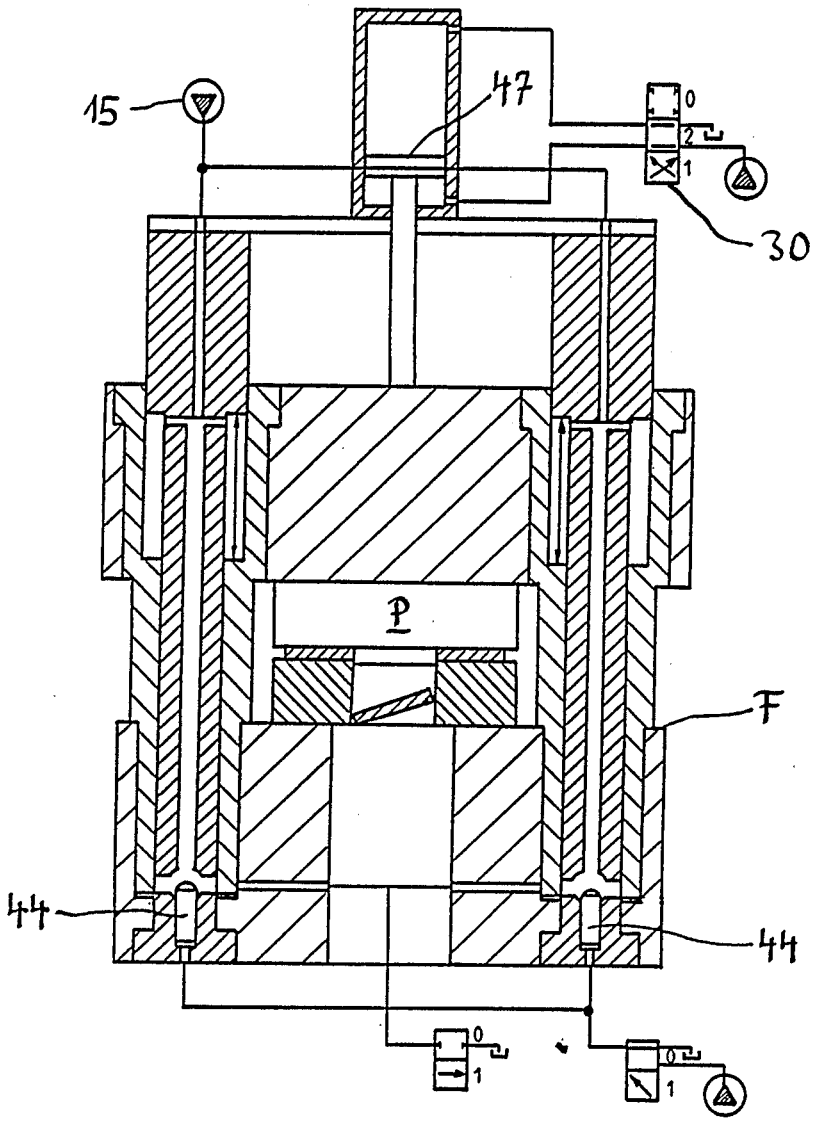

FIG. 5 the press according to FIG. 3 directly at the end of the working stroke.

Figure 6:
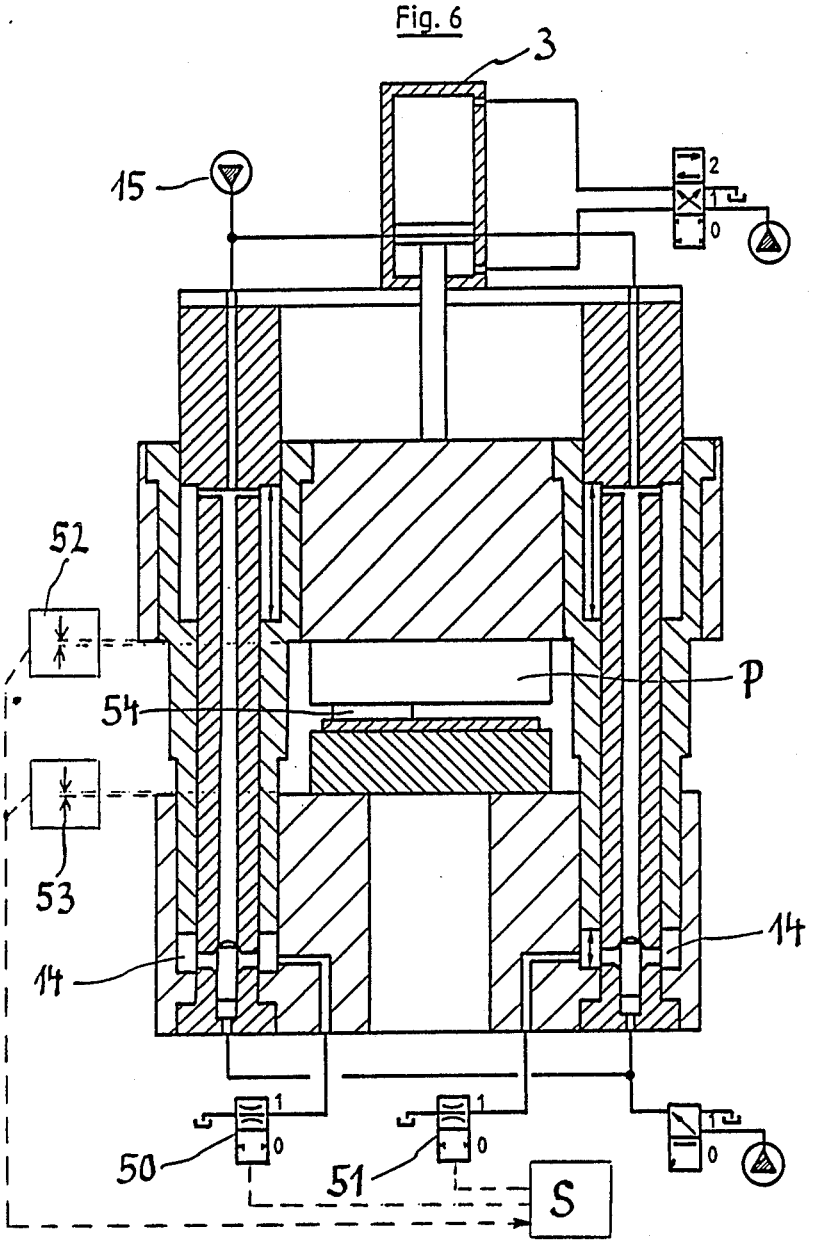

FIG. 6 a further particularly preferred embodiment of the inventive press with individually controllable, lower cylinder chambers.

Figure 7:
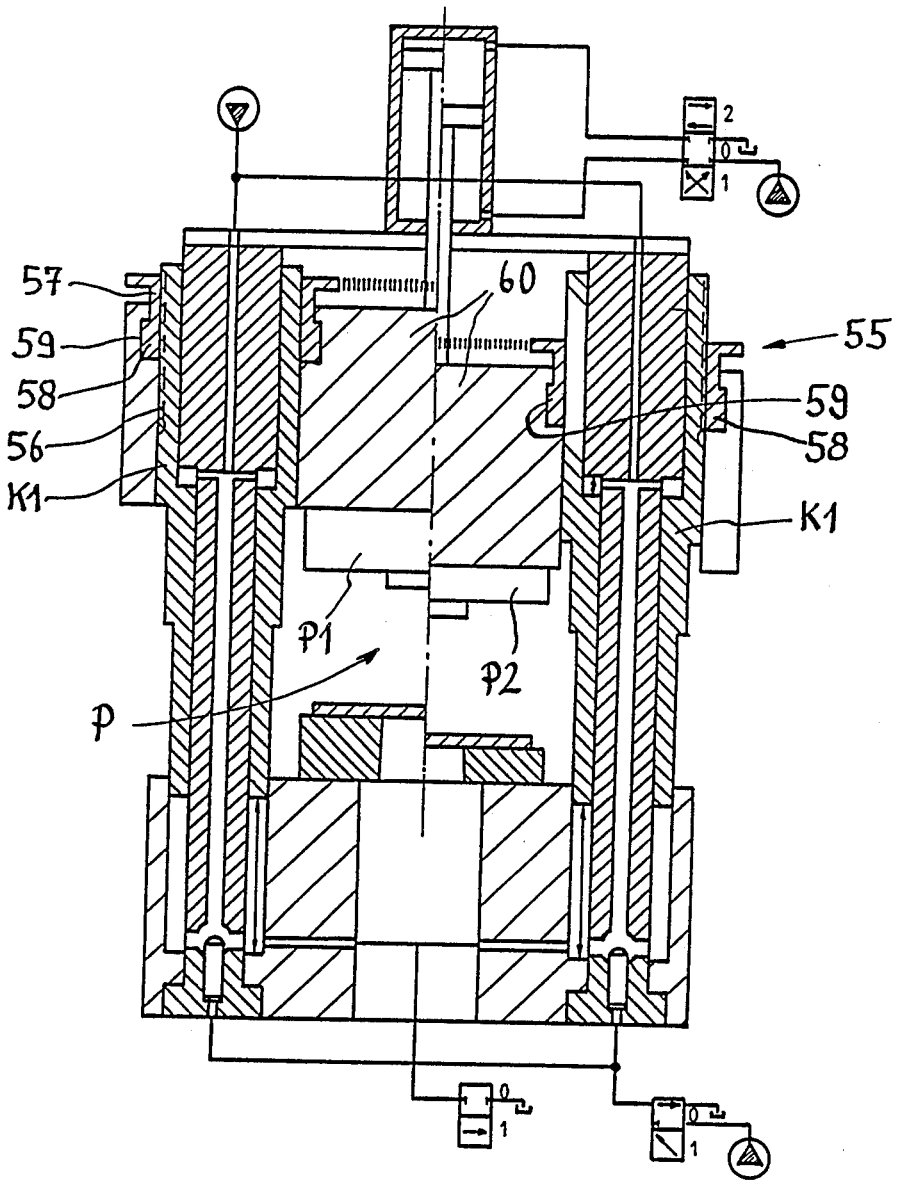

FIG. 7 an embodiment of the press with a mechanical adjusting device in the vicinity of the press crown.

Figure 8:
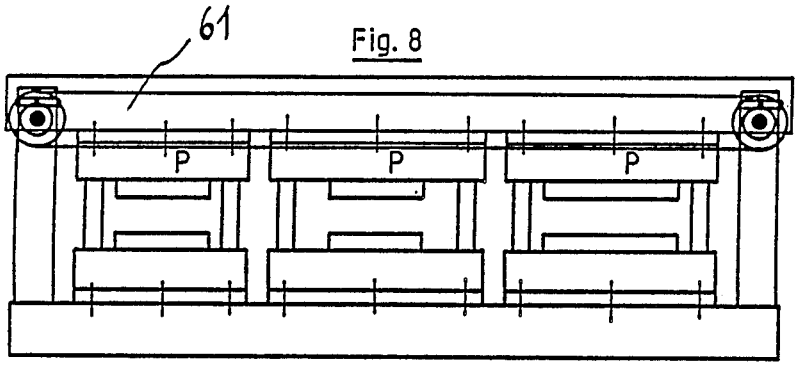
Figure 9:
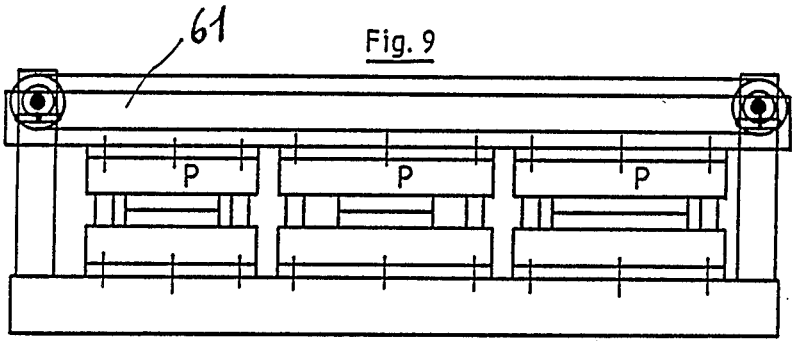

FIGS. 8 and 9 three inventive presses, which are coupled together by a common rapid approach means in different positions.

FIG. 1 shows the left and central part of an inventive hydraulic press in cross-section, the representation having been simplified to illustrate the operation. The press preferably has four tie rods or columns arranged at the corners of the press ram P, and a piston rod K connected to ram P is provided. Only one of the four piston rods is shown in the drawing. Press ram P can be moved downwards by means of an operating cylinder 3 until a working tool 4 mounted thereon comes into engagement with a workpiece 5, which is mounted on the press base 6. The operating cylinder 3 has two pressure chambers 7,8, which can be pressurized, as desired, by means of pressure lines 9,10. If pressure chamber 7 is pressurized, then ram P moves downwards, whereas in the case of the pressurization of pressure chamber 8 ram P moves upwards.

However, the working stroke is not performed with the operating cylinder 3 and instead takes place by means of the piston rods K, which in each case engage with frontal piston faces 11,12 in cylinder chambers 13,14. Cylinder chambers 13,14 are supplied with the same pressure by means of a common hydraulic pump 15, whereby the pressure forces acting on the equally large piston faces 11,12 are identical and lead to no deflection of press ram P. The tie rod 12, which is part of the press frame, links the upper cylinder chamber 13 with the lower cylinder chamber 14, so that the pressures occurring in the cylinder chambers 13,14 stress or tension the tie rods 16, i.e. the latter is expanded slightly, so that it is possible to refer to a prestressing or pretensioning of tie rod 16.

Prior to the start of the actual working stroke the press ram P can be brought into engagement with workpiece 5 by means of the operating cylinder 3. The working stroke can now be initiated in this position and a first controllable valve 17 is brought into the other position, so that the pressure line 18 is interrupted. It is then possible to open a controllable servovalve 19 by means of a control system S, so that there is a pressure drop in cylinder chamber 14. The press ram P now moves downwards in accordance with this pressure drop. There is an opposing force on the workpiece corresponding to the pressing pressure and this has the consequence of the tie rod 16 still remaining prestressed despite the pressure drop in the cylinder chamber 14. At the end of the operating stroke the valves 17,19 are again brought into the represented position, so that in the cylinder chamber 14 there is once again the same pressure as in cylinder chamber 13, Thus, the tie rod 16 also remains prestressed at the end of the working stroke.

Control system S can be operated by means of a keyboard 20 and is connected to a random access memory 21. In the latter can be stored data for different press programmes to which the control system S has access, as a function of the operation via keyboard 20. The control of servovalves forms part of the general prior art, so that no detailed description thereof is given here.

FIG. 2 shows another embodiment, in which the piston rod K is provided at its two ends with pistons 22,23, which engage in cylinder 24,25 mounted on the press frame. The resulting cylinder chambers 13,14 functionally correspond to cylinder chambers 13,14 in FIG. 1. The upper part of the press 26 is connected with the lower part of the press 27 by means of columns, tie rods, etc., but these are not shown in FIG. 2.

FIG. 3 shows a first preferred embodiment of the press in detail. The press ram P is located here in the upper starting position. All the control valves 28,29 and 30 are located in the operating position O and the cylinder chambers 13,14 are pressurized with pressure from pressure source 15. The latter is for this purpose hydraulically connected with the cylinder chambers 13,14 via pressure lines 31,32 and longitudinal bores 33,34 running in tie rods 35,36. In the vicinity of cylinder chambers 13,14 are also provided cross-bores 37,38, which lead to the cylinder chambers 13,14.

In the preferred embodiment the piston rods Kl are tubular and surround the tie rods 35,36, which can form the press columns. On the upper cylinder chamber 13, piston Kl forms a circular piston face 39, which faces the cylinder chamber 13 constructed as an annulus. At the lower end of piston rod Kl is constructed an equally large piston face 40, which faces cylinder chamber 14 constructed as an annulus.

The lower cylinder chambers 14 are interconnected via through-bores 41 and pressure lines 42, so that in the represented press position the same pressure prevails in all the cylinder chambers 13,14. In this state, press ram P can be brought downwards into the working position without any great force expenditure using the operating cylinder 3 and this is shown in FIG. 4.

In order to initiate the working stroke, according to FIG. 4 controllable valves 28,29 are switched over, so that they move from position O into position 1 shown in FIG. 4. As a result of pressure in the pressure line 43 following valve 29 the piston valves 44 are brought from the position according to FIG. 3 into the position according to FIG. 4. Thus, the connection between the lower cylinder chambers 14 and the upper cylinder chambers 13 is interrupted, because the piston valve 44 shuts off the in each case associated longitudinal bore 33 or 34. As a result of the controllable valve 28 it is not possible to reduce pressure in the lower cylinder chambers 14, so that pressure flows out into a tank 46 via lines 42 and 45. Valve 28 can be opened and closed in a clearly defined manner, so that there can be a clearly defined pressure reduction in cylinder chambers 14 and therefore a controlled initiation of the working stroke. During the working stroke the press ram is supported on workpiece 5 and the resulting reaction forces maintain the prestress in the tie rods 35,36.

FIG. 5 shows the position of the ram P at the end of the working stroke. Precisely in this position the valves 28,29 are brought into position O, so that piston valves 44 open again and the pressure in the lower cylinder chambers 14 is again the same as the pressure in the upper cylinder chambers 13. The constant prestress of tie rods 35,36 is therefore maintained.

Valve 30 can now be brought into position 2, so that there is a pressure rise in pressure chamber 8 and piston 47 of operating cylinder 3 is brought into the position according to FIG. 3. Thus, a working cycle is concluded and farther cycles can follow in a corresponding manner and the stressing of the press is always maintained. This function can be called a constant, dynamic prestress.

FIG. 6 shows an embodiment in which the pressing force is separately regulatable in each lower cylinder chamber 14. For this purpose pressure valves 50,51 are provided, which are separately operable by the control system S. This particularly preferred embodiment is especially advantageous if there are eccentric loads, such as is the case with an eccentrically positioned tool 54. Such an eccentric loading brings about a tilt of the ram P without equilibrium of forces in the cylinder chambers. This can be determined by means of suitable sensors using an angular measurement or a difference - displacement measurement. Such measuring processes for determining angles or distances form part of the general prior art, so that no description thereof is given. However, it is important that as a function of the determined sensor values control system S controls the pressure valves 50,51 in such a way that different pressures can be obtained in the lower cylinder chambers 14 during the working stroke in order to minimize the tilt of the ram P. The measurement of the tilt of pressure ram P takes place by means of two sensors 52,53, whose signals are supplied to control system S. Sensors 52,53 can be constituted by four linear displacement transducers.

It is expressly pointed out that in the case of the inventive press during the working stroke the lower cylinder chamber 14 have such a limited height and this reaches its minimum value at the end of the stroke, e.g. in the millimetre range. This can also be gathered from FIG. 5. In this position (working stroke end) the piston rods Kl engage against a fixed stock F (FIG. 5). Through minimizing the cylinder chambers 14 very good control characteristics and an effective cutting impact damping are obtained.

FIG. 7 shows an adjusting means 55 enabling the longitudinal displacement of the press ram P along the piston rods Kl. For this purpose a thread 56 is formed at the upper end of the tubular piston rod Kl and onto it is screwed an adjusting nut 57. The adjusting nuts have shaped-on flanges 58, which engage in corresponding grooves 59 on the press top 60. By adjusting the nuts 57 the press top 60 and therefore the press ram P can be e.g. brought into the two represented positions P1,P2.

FIGS. 8 and 9 show three presses of the inventive type, which in each case have a common rapid approach means 61 in place of separate operating cylinders. In FIG. 8 means 61 is located in the upper position, whereas FIG. 9 shows the lower position, in which the working stroke can be initiated in the manner described hereinbefore.

I claim:

1. A hydraulic press comprising a press ram; a press base; a first motor means for vertically moving said press ram from a non-working position to a working position; second motor means for biasing said press ram during its working stroke, said second motor means comprises first and second pistons each having a pair of end faces, said pistons being secured to said press ram and mounted for vertical movement within first and second cylinders wherein each end face of the pistons defines with each cylinder a first and second chamber; a tie rod rigidly interconnecting the ends of each of said first and second cylinders defining said chambers; and pressure generator means for selectively controlling the pressure in said first and second chambers such that said tie rods are under substantially constant stress during all operating phases of the hydraulic press.

2. A press according to claim 1 wherein the piston end faces are substantially the same size and wherein the chambers are connected to a common pressure generator means such that the pressure in one of the first and second chambers can be lowered compared with the pressure in the other chamber.

3. A press according to claim 1 wherein the pistons surround in a tubular manner the tie rods and the chambers form annular rings located at the ends of the tie rods.

4. A press according to claim 3 wherein each tie rod is provided with a longitudinal bore which can be shut off from said pressure generator means by a valve, said bore being connected to said chambers by means of cross-bores located at the both ends of the tie rods.

5. A press according to claim 1 wherein a servovalve controls the pressure in the said one chamber.

6. A press according to claim 2 wherein the pressure in said one chamber is reduced as a function of the eccentric loading of the press ram during the working stroke.

7. A press according to claim 6 wherein a control valve controls the reduction of pressure in response to sensors which determine the tilt of the press ram occurring on loading.

8. A press according to claim 1 wherein an adjusting device is provided for mechanically adjusting the maximum spacing between the press ram and the press base.

9. A press according to claim 8 wherein the adjusting device comprises an adjusting nut which is screwed from above onto the piston rod provided with an external thread.

10. A press according to claim 1 including a plurality of presses which are juxtaposed and are coupled to an upper common rapid approach means.

* * * * *